US012471643B2

(12) United States Patent
Fujiwara et al.

(10) Patent No.: US 12,471,643 B2
(45) Date of Patent: Nov. 18, 2025

(54) DETACHABLE HOOD SYSTEM

(71) Applicant: KJUS North America, Inc., Fairhaven, MA (US)

(72) Inventors: Shogo Fujiwara, Boulder, CO (US); Amanda Frank, Boulder, CO (US); Adam Mueller, Denver, CO (US)

(73) Assignee: Acushnet Company, Fairhaven, MA (US)

( * ) Notice: Subject to any disclaimer, the term of this patent is extended or adjusted under 35 U.S.C. 154(b) by 154 days.

(21) Appl. No.: 17/985,988

(22) Filed: Nov. 14, 2022

(65) Prior Publication Data

US 2023/0270188 A1 Aug. 31, 2023

Related U.S. Application Data

(60) Provisional application No. 63/282,839, filed on Nov. 24, 2021.

(51) Int. Cl.
*A41D 1/02* (2006.01)
*A41D 13/00* (2006.01)

(52) U.S. Cl.
CPC ..... *A41D 13/0015* (2013.01); *A41D 1/02* (2013.01); *A41D 2200/20* (2013.01)

(58) Field of Classification Search
CPC ..... A41D 1/02; A41D 2200/20; A41D 3/00; A41D 3/02; A41D 15/00; A42B 1/048
USPC ..... 2/84, 202
See application file for complete search history.

(56) References Cited

U.S. PATENT DOCUMENTS 2,086,325 A * 7/1937 Frankel ..... A41D 3/00 2/202
2,129,454 A 9/1938 Wilkie
2,170,339 A * 8/1939 Reeves ..... A41D 3/00 2/84
2,264,314 A * 12/1941 Johns ..... A41D 27/18 2/139
2,682,056 A * 6/1954 Werber ..... A41D 3/00 2/84
3,102,570 A 9/1963 Fairchilds
4,513,451 A 4/1985 Brown
4,569,089 A * 2/1986 Nesse ..... A41D 3/00 2/108
4,608,715 A 9/1986 Miller
5,180,057 A 1/1993 Franklin
5,603,646 A * 2/1997 Tobias ..... A41D 13/0125 441/106

(Continued)

*Primary Examiner* — Jameson D Collier
(74) *Attorney, Agent, or Firm* — Kristin D. Wheeler

(57) ABSTRACT

A garment that includes a right chest panel; a left chest panel; a back panel; and a collar coupled to the right chest panel, the left chest panel, and the back panel. The collar may include a collar zipper controlling access to a collar pocket, the collar zipper extending around at least 80% of an outer circumference of the collar; and a collar-side row of hood-connection zipper teeth positioned in the collar pocket, the collar-side row of hood-connection zipper teeth having a length that is at least 80% of a length of the collar zipper. The garment may also include a removable hood. The removable hood may include a hood-side row of hood-connection zipper teeth, the hood-side row of hood-connection zipper teeth having a length that is substantially equal to the length of the collar-side row of hood-connection zipper teeth.

19 Claims, 9 Drawing Sheets

(56) References Cited

U.S. PATENT DOCUMENTS 5,673,836 A * 10/1997 Bush ..... F41C 33/0245 224/582
5,718,000 A * 2/1998 Ost ..... A41D 13/0012 2/93
5,815,833 A * 10/1998 Kuo ..... A47G 9/086 5/413 AM
5,826,273 A 10/1998 Eckes
5,953,758 A 9/1999 Foster
6,047,404 A * 4/2000 Blanks, I ..... A41D 15/005 2/108
6,253,379 B1 7/2001 Collier
6,298,487 B1 10/2001 Mayhew
6,370,692 B1 * 4/2002 Duyn ..... A41D 3/02 2/202
6,558,062 B1 5/2003 Wyant
6,598,235 B2 7/2003 Bulla
7,908,675 B2 3/2011 Robinson
8,336,116 B2 12/2012 Seguin et al.
8,438,665 B2 5/2013 Roemer et al.
8,555,414 B2 10/2013 Davis et al.
8,671,464 B2 3/2014 Silverberg
D739,646 S * 9/2015 Meguid ..... D2/831
9,491,994 B2 11/2016 Sherr
9,980,526 B2 5/2018 Silverberg
10,092,050 B2 * 10/2018 Skurla, III ..... A41D 3/00
10,772,372 B2 9/2020 O'Connor et al.
10,918,148 B2 2/2021 Brandt et al.
11,013,276 B2 5/2021 Koller
2008/0184454 A1 * 8/2008 Collier ..... A41D 1/06 2/243.1
2010/0043117 A1 2/2010 Hildebrandt
2010/0313387 A1 * 12/2010 Peters ..... A44B 19/38 24/381
2015/0013046 A1 1/2015 Coleman
2015/0327612 A1 * 11/2015 Bublitz ..... A41D 15/005 2/202
2018/0271196 A1 * 9/2018 Hussey ..... A41D 13/1153
2019/0261718 A1 * 8/2019 O'Connor ..... A41D 3/02
2020/0138134 A1 * 5/2020 McMahon ..... A41D 27/28

* cited by examiner

DETACHABLE HOOD SYSTEM

CROSS-REFERENCE TO RELATED APPLICATIONS

This application claims the benefit of U.S. Provisional Application No. 63/282,839, filed Nov. 24, 2021, the entire disclosure of which is incorporated by reference.

BACKGROUND

Jackets, coats, or other similar garments that are worn in cold weather environments may have a variety of features to improve the protection and/or overall comfort of the wearer. For instance, jackets may include waterproofing features, wind protection features, insulation, etc. Some jackets may also include a hood to protect the wearer's head. Jackets may also include features that improve the utility of the jacket. For example, jackets may include pockets or other storage components to allow the wearer to carry additional items while wearing the jacket.

It is with respect to these and other general considerations that the aspects disclosed herein have been made. Also, although relatively specific problems may be discussed, it should be understood that the examples should not be limited to solving the specific problems identified in the background or elsewhere in this disclosure.

SUMMARY

Examples of the present disclosure describe systems and methods for an improved garment such as a jacket. In an aspect, the present technology relates to a garment that includes a right chest panel; a left chest panel; a back panel; and a collar coupled to the right chest panel, the left chest panel, and the back panel. The collar includes a collar zipper controlling access to a collar pocket, the collar zipper extending around at least 80% of an outer circumference of the collar; and a collar-side row of hood-connection zipper teeth positioned in the collar pocket, the collar-side row of hood-connection zipper teeth having a length that is at least 80% of a length of the collar zipper. The garment also includes a removable hood. The removable hood includes a hood-side row of hood-connection zipper teeth, the hood-side row of hood-connection zipper teeth having a length that is substantially equal to the length of the collar-side row of hood-connection zipper teeth.

In an example, the removable hood further comprises at least one zipper slider permanently attached to the hood-side row of hood-connection zipper teeth and configured to selectively receive the collar-side row of hood-connection zipper teeth. In yet another example, the collar-side row of hood-connection zipper teeth is split into a left portion of zipper teeth and a right portion of zipper teeth. In a further example, the garment further includes a left zipper slider permanently attached to the hood-side row of hood-connection zipper teeth, the left zipper slider configured to selectively receive the left portion of zipper teeth; and a right zipper slider permanently attached to the hood-side row of hood-connection zipper teeth, the right zipper slider configured to selectively receive the right portion of zipper teeth. In still another example, the collar zipper includes a left zipper slider and a right zipper slider, wherein separating the left zipper slider from the right zipper slider opens the collar zipper. In still yet another example, the collar-side row of hood-connection zipper teeth extends around at least 80% of the outer circumference of the collar.

In another example, the hood-side row of hood-connection zipper teeth extends from a left hood-opening edge to a right hood-opening edge. In yet another example, the collar zipper has a length greater than a length of the collar-side row of hood-connection zipper teeth. In still another example, the garment further includes a right neck panel; a left neck panel; and the collar zipper extends from a right edge of the right neck panel to a left edge of the left neck panel. In a further example, the garment is a ski jacket.

In another aspect, the technology relates to a garment including a right chest panel; a left chest panel; a back panel; a right neck panel; a left neck panel; and a collar coupled to the right chest panel, the left chest panel, the right neck panel, the left neck panel, and the back panel. The collar includes a collar zipper controlling access to a collar pocket, the collar zipper extending from a right edge of the right neck panel to a left edge of the left neck panel; and a collar-side row of hood-connection zipper teeth positioned in the collar pocket. The garment also includes a removable hood that includes a hood-side row of hood-connection zipper teeth, wherein the hood-side row of hood-connection zipper teeth has a length that is substantially equal to a length of the collar-side row of hood-connection zipper teeth.

In an example, the removable hood further comprises at least one zipper slider permanently attached to the hood-side row of hood-connection zipper teeth and configured to selectively receive the collar-side row of hood-connection zipper teeth. In another example, the collar further includes at least one zipper slider permanently attached to the collar-side row of hood-connection zipper teeth and configured to receive the hood-side row of hood-connection zipper teeth. In still another example, the collar zipper extends around at least 80% of an outer circumference of the collar. In yet another example, the hood-side row of hood-connection zipper teeth extends from a left hood-opening edge to a right hood-opening edge. In still yet another example, the garment further includes a primary zipper positioned between the right chest panel and the left chest panel and between the right neck panel and the left neck panel.

In another aspect, the technology relates to a garment including a collar and a a removable hood. The collar includes a collar pocket; collar zipper controlling access to the collar pocket; and a collar-side row of hood-connection zipper teeth positioned in the collar pocket, wherein the collar-side row of hood-connection zipper teeth extends around at least 80% of an outer circumference of the collar. The removable hood includes a hood-side row of hood-connection zipper teeth, wherein the hood-side row of hood-connection zipper teeth extends around at least 80% of a circumference of a bottom edge of the removable hood; and at least one zipper slider permanently attached to one of the collar-side row of hood-connection zipper teeth or the hood-side row of hood-connection zipper teeth and configured to selectively receive one of the collar-side row of hood-connection zipper teeth or the hood-side row of hood-connection zipper teeth.

In an example, the collar zipper has a length greater than a length of the collar-side row of hood-connection zipper teeth. In another example, the collar pocket does not include enough storage space to store the removable hood. In yet another example, the removable hood includes a right hood-opening edge and a left hood-opening edge, and the removable hood does not include attachment mechanisms for attaching the right hood-opening edge to the left-hood opening edge.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Additional aspects, features, and/or advantages of examples will be set forth in part in the description which follows and, in part, will be apparent from the description, or may be learned by practice of the disclosure.

BRIEF DESCRIPTION OF THE DRAWINGS

Non-limiting and non-exhaustive examples are described with reference to the following figures.

DETAILED DESCRIPTION

As discussed above, garments that are intended for use in cold-weather environments have a variety of features that improve the protection, comfort, and/or utility of the garments. Such garments, may include coats, jackets, sweaters, base layers, quarter zip shirts, half-zip shirts, etc. While the present application primarily discusses the technology in terms of a "jacket" and particularly a ski jacket, it should be appreciated that the features discussed herein may be incorporated into any type of garment for which the feature would be beneficial.

Among other things, the present technology includes a jacket with a detachable hood system. The detachable hood system provides for robust, structured hoods to be utilized in the system by providing extended connection points that allow for a more secure hood-attachment system. In addition, the hood-attachment system may be protected from the environment (snow, rain, etc.) when the hood is not attached or in use.

The present technology also includes a central venting system that improves ventilation of the jacket through the central part of the chest. The venting system further includes face venting features that protect the wearer's face while still allowing for breath to escape the front of the jacket, which can alleviate issues relating to internal condensation in the jacket and fogging of eyewear such as ski goggles.

Improved pockets are also incorporated. For instance, expandable pockets are incorporated on the front of the jacket. When an exterior zipper is unzipped, a gusset of the pocket may be expanded to provide additional storage space in the pocket. A hand-warmer pocket may also be incorporated at or near the end or cuff of the sleeve(s) of the jacket. The hand-warmer pocket provides an opening for placement of a hand warmer, which warms the wrist and hand of the wearer, particularly when the wearer is also wearing gloves.

Figure 2:
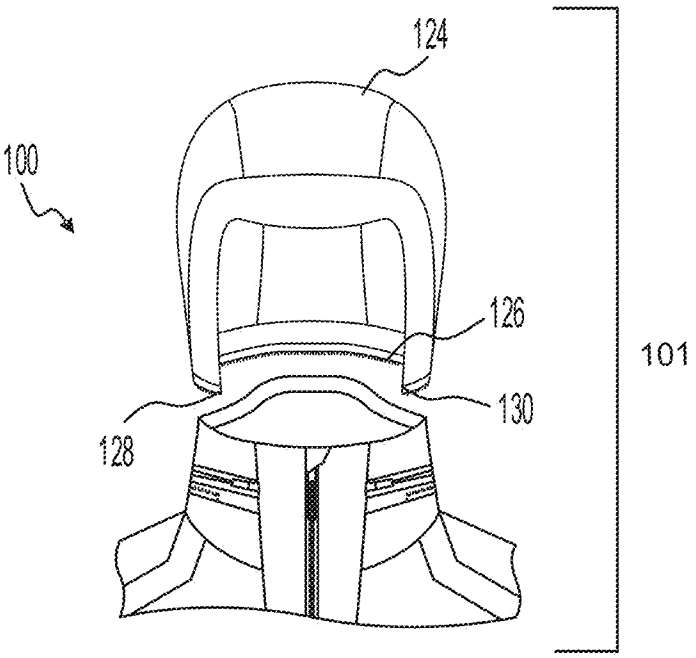
FIG. 2 depicts another front view of the jacket with the detachable hood system.
Figure 1:
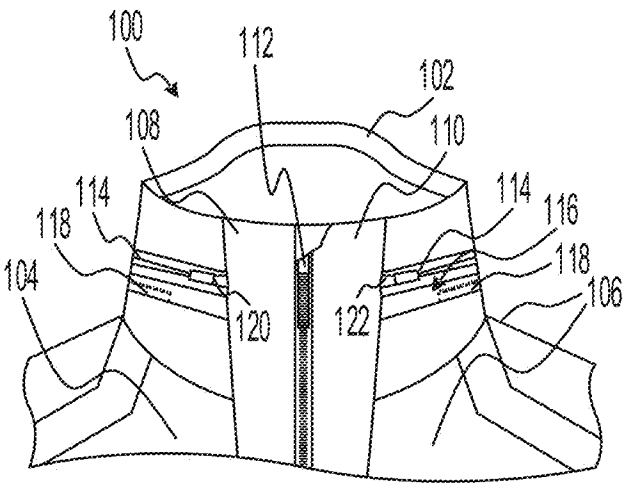
FIG. 1 depicts a front view of a jacket with a detachable hood system.

FIG. 1 depicts a front view of an example jacket 100 with a detachable hood system 101. FIG. 2 depicts another front view of the jacket 100 with the detachable hood system 101 with a hood 124 in a detached state. FIGS. 1-2 are discussed concurrently.

The jacket 100 includes a collar 102, a right chest panel 104, a left chest panel 106, a right neck panel 108, and a left neck panel 110. The collar 102 may be coupled to the right chest panel 104, the left chest panel 106, the right neck panel 108, and the right neck panel 108. For instance, the collar 102 may be attached to the other components via stitching, bonding, or other suitable attachment means. The right chest panel 104 and the left chest panel 106 make up a portion of the front of the jacket 100. The right neck panel 108 and the left neck panel 110 are located between and/or above the right chest panel 104 and the left chest panel 106.

The jacket 100 may also include a primary zipper 112 that extends from the top of the collar 102 to the bottom of the jacket 100 on the front side of the jacket 100. The primary zipper 112 allows for the jacket 100 to be opened or closed. The primary zipper 112 is positioned between the right neck panel 108 and the left neck panel 110. The primary zipper 112 is also positioned between the right chest panel 104 and the left chest panel 106. The primary zipper 112 may also be attached to the right chest panel 104, the left chest panel 106, the right neck panel 108, and the left neck panel 110. For instance, the left row of teeth of the primary zipper 112 may be attached to the left chest panel 106 and the left neck panel 110. Similarly, the right row of teeth of the primary zipper 112 may be attached to the right chest panel 104 and the right neck panel 108.

The collar 102 includes portion of a detachable hood system. For example, the collar 102 may include a collar zipper 114 that includes one or more zipper sliders 120, 122. In the example depicted, the collar zipper 114 includes a right zipper slider 120 and a left zipper slider 122. The right zipper slider 120 and the left zipper slider 122 are used to open and close the collar zipper 114. For instance, when the right zipper slider 120 and the left zipper slider 122 are brought together, the collar zipper 114 is in a closed position. When the right zipper slider 120 and the left zipper slider 122 are pulled apart from one another (as shown in FIG. 1), the collar zipper 114 is in an open position. In other examples, only a single zipper slider may be included on the collar zipper 114, and opening and closing the collar zipper 114 may be achieved by sliding the zipper slider from one end of the collar zipper 114 to the other end of the collar zipper 114. By including two zipper sliders 120, 122, however, use of the zippers by a wearer may be improved. For instance, a user may be better able to reach and manipulate the two zipper sliders 120, 122 than a user would be able to manipulate a single zipper slider. As an example, with two zipper sliders 120, 122, a wearer may manipulate the first zipper slider 120 with one hand and manipulate the second zipper slider 122 with a second hand. The two-zipper-slider example may be particularly helpful to the wearer where the collar zipper 114 extends substantially around the entire collar 102.

The collar zipper 114 may extend from the right edge of the right neck panel 108 to the left edge of the left neck panel 110. In some examples, the collar zipper 114 may extend around at least 80% or 90% of the outer circumference of the collar 102. For instance, a portion the collar zipper 114 may be present on the front side of the collar 102 on the left and/or right sides of the jacket 100. Having a longer collar zipper 114 allows for a more robust and durable detachable hood system that is capable of utilizing a more structured hood, as discussed further herein.

A collar pocket 116 is included under the collar zipper 114, and access to the collar pocket 116 is controlled by opening or closing the collar zipper 114. The collar pocket 116 includes a collar-side row of hood-connection zipper teeth 118. Accordingly, when the collar zipper 114 is opened, the collar-side row of hood-connection zipper teeth 118 are exposed to the environment, and a wearer can access the collar-side row of hood-connection zipper teeth 118.

As discussed above, the present detachable hood system allows for more structured hoods 124 to be utilized with the jacket 100. As a result, the collar pocket 116 may not include enough storage space to store the hood 124. By not relying on the collar pocket 116 for hood storage, the collar pocket 116 may be made smaller and remove bulk from the collar 116, which may add additional comfort for the wearer.

Similar to the collar zipper 114, the collar-side row of hood-connection zipper teeth 118 may wrap around a substantial portion of the collar 102. For instance, a portion of the collar-side row of hood-connection zipper teeth 118 may be located in the front of the jacket 100, such as above the right chest panel 104 and/or the left chest panel 106. In some examples, the length of the collar-side row of hood-connection zipper teeth 118 may be at least 80% or 90% the length of the collar zipper 114.

The hood 124 includes a hood-side row of hood-connection zipper teeth 126 that are configured to mate with the collar-side row of hood-connection zipper teeth 118 to attach the hood 124 to the collar 102. For instance, the collar-side row of hood-connection zipper teeth 118 and the hood-side row of hood-connection zipper teeth 126 form two rows of teeth of a hood-connection zipper, and when a zipper slider is zipped over the two rows of teeth, the hood 124 is attached to the collar 102. The hood-side row of hood-connection zipper teeth 126 may extend from a right hood-opening edge 128 of the hood 124 to a left hood-opening edge 130 of the hood 124. In other examples, the hood-side row of hood-connection zipper teeth 126 extends around at least 80% or 90% of the circumference of the bottom edge of the hood 124. The length of the hood-side row of hood-connection zipper teeth 126 is substantially the same as the length of the collar-side row of hood-connection zipper teeth 118. Accordingly, the length of the collar-side row of hood-connection zipper teeth 118 may be based on the size of the hood 124 and, therefore, the length of the hood-side row of hood-connection zipper teeth 126.

By having the hood-side row of hood-connection zipper teeth 126 extend around a larger portion of the bottom of the hood 124, a greater portion of the hood 124 is physically connected to the collar 102, which provides for greater durability and a lower likelihood that the hood 124 will be unintentionally ripped off of the jacket 100 during use. In addition, the increased length of the hood-side row of hood-connection zipper teeth 126 also removes the need for an additional attachment mechanism at the front of the hood 124, such as a hook-and-loop strap, button, etc., to attach the right hood-opening edge 128 to the left hood-opening edge 130. For instance, if the hood-side row of hood-connection zipper teeth 126 was shorter and located just in the back portion of the hood 124, the front portion of the hood 124 (such as the right hood-opening edge 128 and the left hood-opening edge 130) would easily flap in the wind and provide little protection to the wearer.

Figure 3:
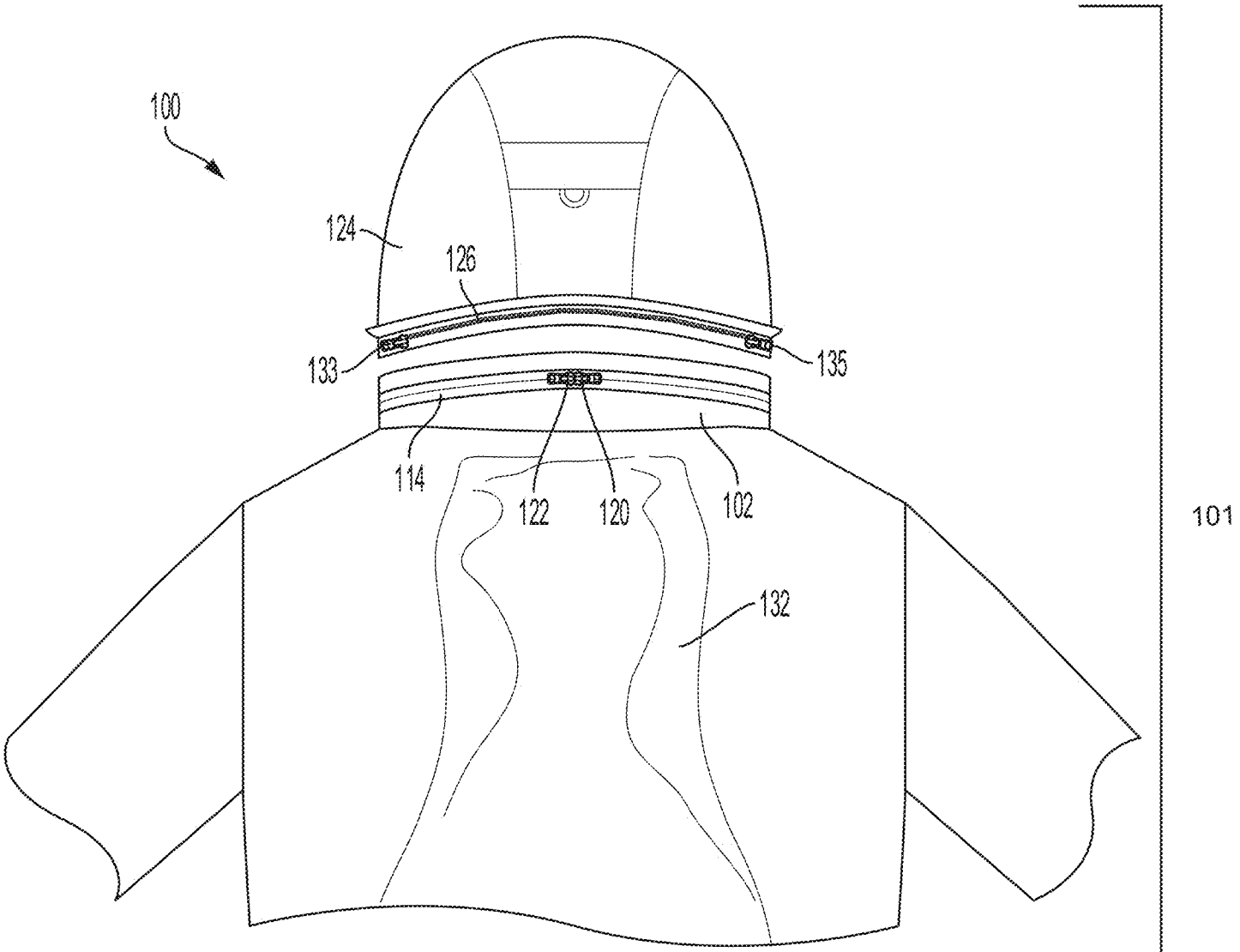
FIG. 3 depicts a back view of the jacket with a collar zipper in a closed position.

FIG. 3 depicts a back view of the example jacket 100 with a collar zipper 114 in a closed position. When the collar zipper 114 is in the closed position, the right zipper slider 120 and the left zipper slider 122 are abutting one another. When the collar zipper 114 is in the closed position, the right zipper slider 120 and the left zipper slider 122 may be located in a central portion of the collar zipper 114, such as above a back panel 132 of the jacket 100, as depicted in FIG. 3. In other examples, the zipper sliders 120, 122 may be slid to one side or another of the collar zipper 114. For instance, the zipper sliders 120, 122 may be slid to a position above the right chest panel 104 or the left chest panel 106. When the collar zipper 114 is in the closed position, the collar pocket 116 is protected from the environment as the collar zipper 114 and the material of the collar 102 may be substantially waterproof. Thus, the collar pocket 116 and the collar-side row of hood-connection zipper teeth 118 are protected.

In the example depicted in FIG. 3, the hood-side row of hood-connection zipper teeth 126 includes left hood zipper slider 133 and a right hood zipper slider 135. In other examples, the hood-side row of hood-connection zipper teeth 126 may include only a single zipper slider. In still other examples, the zipper slider(s) may be permanently incorporated onto the collar-side row of hood-connection zipper teeth 118 rather than the hood-side row of hood-connection zipper teeth 126.

Figure 4:
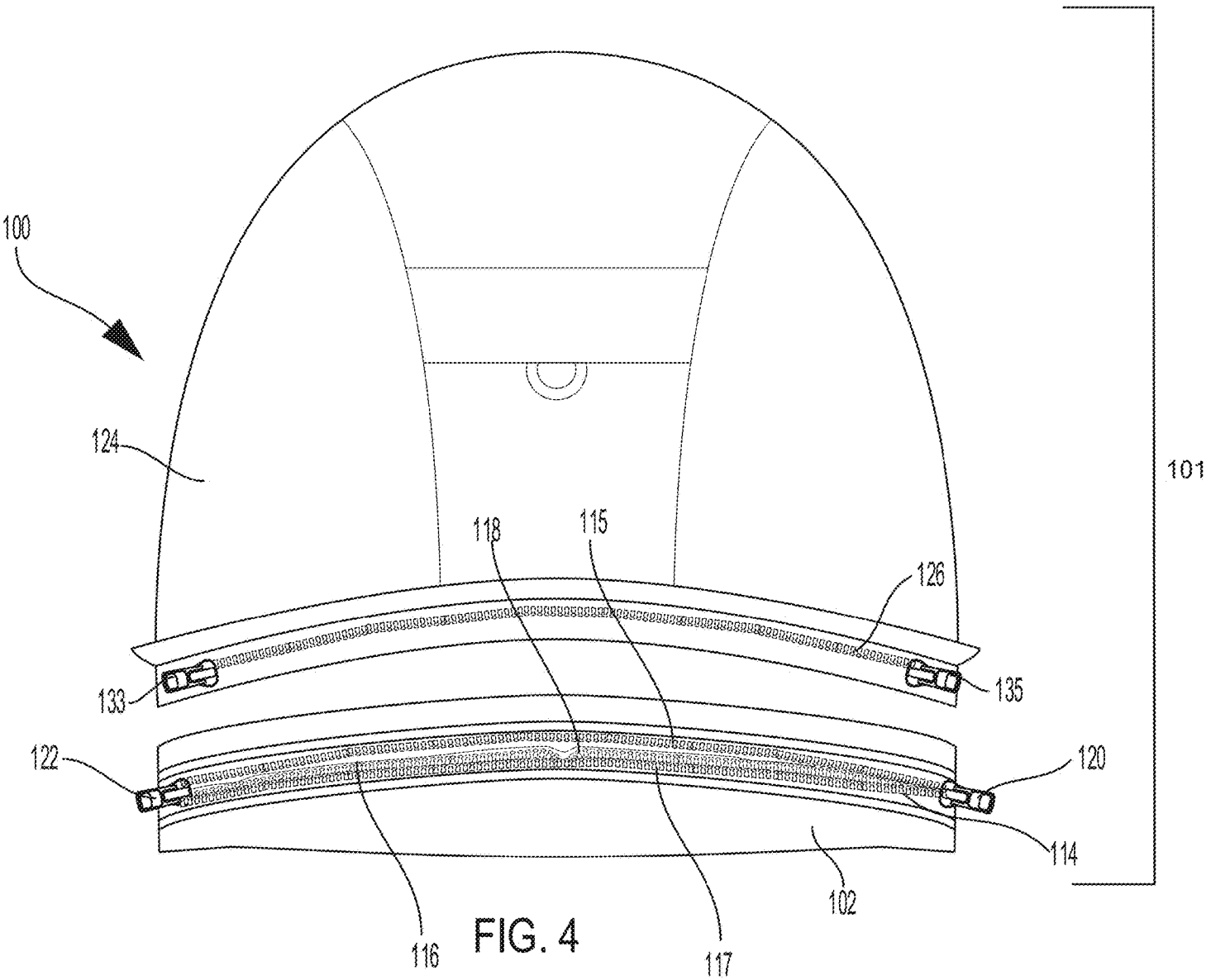
FIG. 4 depicts another back view of the jacket with the collar zipper in the open position.

FIG. 4 depicts another back view of the jacket 100 with the collar zipper 114 in the open position. When the collar zipper 114 is in the open position, the first zipper slider 120 and the left zipper slider 122 have been pulled apart from one another. When the collar zipper 114 is in the open position, the collar pocket 116 is opened and the collar-side row of hood-connection zipper teeth 118 may be accessed. For example, separating the right zipper slider 120 from the left zipper slider 122 opens the collar zipper 114 and separates a top row of teeth 115 and a bottom row of teeth 117 of the collar zipper 114. The collar-side row of hood-connection zipper teeth 118 may extend between the top row of teeth 115 and the bottom row of teeth 117 of the collar zipper 114.

In some examples, the hood-side row of hood-connection zipper teeth 126 may be split into two rows of zipper teeth, such as a left side of zipper teeth and a right side of zipper teeth. Similarly, the collar-side row of hood-connection zipper teeth 118 may be split into two rows of zipper teeth, such as a left side or portion of zipper teeth and a right side or portion of zipper teeth. The left side of collar-side row of hood-connection zipper teeth 118 may be aligned with the left side of hood-side row of hood-connection zipper teeth 126, and the right side of hood-side row of hood-connection zipper teeth 126 may be aligned with the right side of the collar-side row of hood-connection zipper teeth 118. The left portion of zipper teeth may be separated from the right side of the zipper teeth such that a zipper slider cannot slide from the left portion of zipper teeth to the right portion of zipper teeth.

Figure 5:
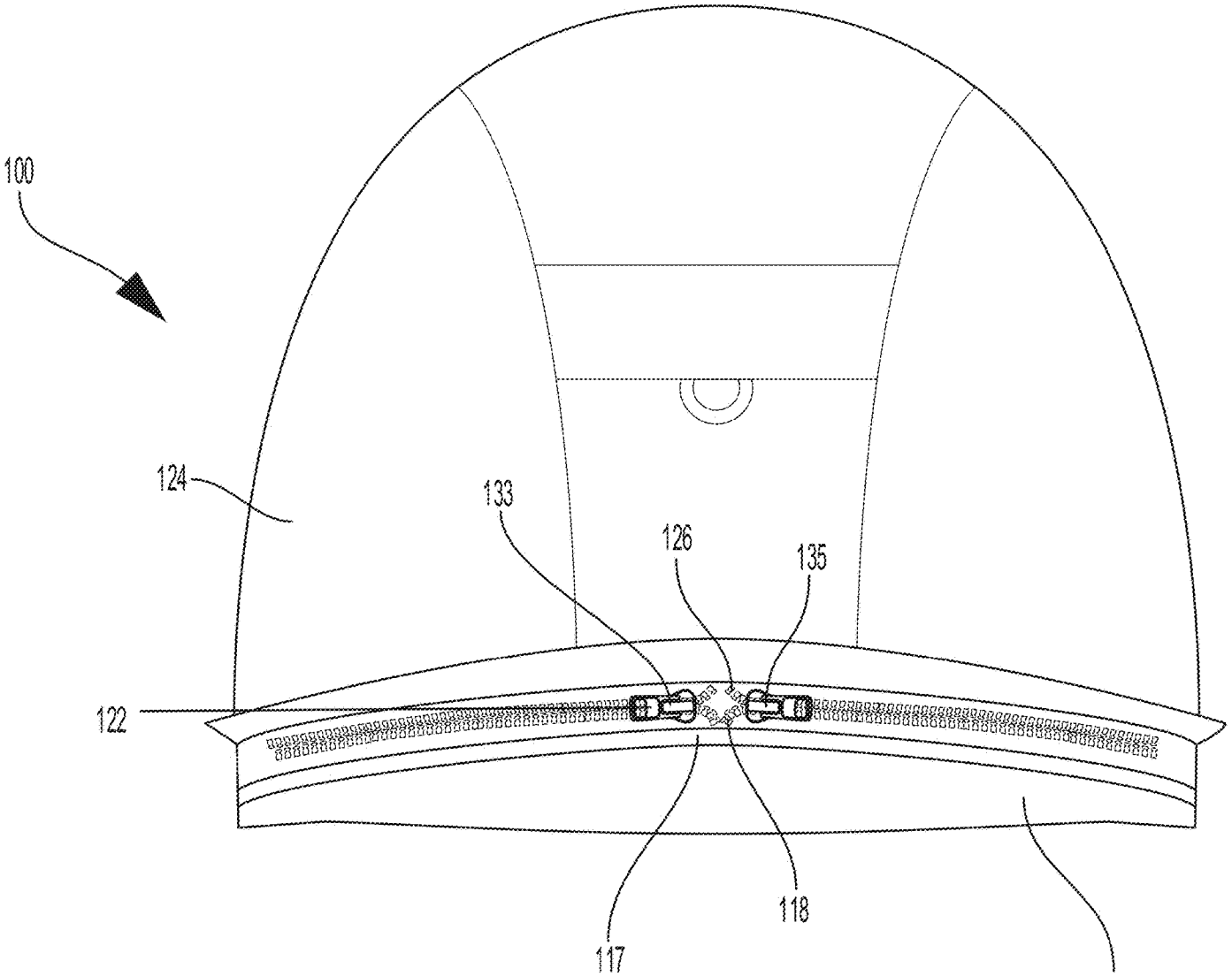
FIG. 5 depicts a back view of the jacket with a hood attached to the collar.

FIG. 5 depicts a back view of the jacket 100 with the hood 124 attached to the collar 102. To attach the hood 124 to the collar 102, one or more of the sliders 133, 135 are slid across the collar-side row of hood-connection zipper teeth 118 and the hood-side row of hood-connection zipper teeth 126 to join the collar-side row of hood-connection zipper teeth 118 with the hood-side row of hood-connection zipper teeth 126. For instance, the hood-side row of hood-connection zipper teeth 126 is received in one throat of the slider 133 and the collar-side row of hood-connection zipper teeth 118 is received in the other throat of the slider 133. The left hood zipper slider 133 may be slid to a position adjacent to the right hood zipper slider 135 to attach the hood 124 to the collar by joining the collar-side row of hood-connection zipper teeth 118 with the hood-side row of hood-connection zipper teeth 126. In other examples, only a single zipper slider may be incorporated to join the collar-side row of hood-connection zipper teeth 118 with the hood-side row of hood-connection zipper teeth 126. In such examples, the single zipper slider may be slid from the left side to the right side, or the right side to the left side, of the collar-side row of hood-connection zipper teeth 118 and the hood-side row of hood-connection zipper teeth 126.

In the example depicted, the hood-side row of hood-connection zipper teeth 126 and the collar-side row of hood-connection zipper teeth 118 are each split into a left portion and a right portion. Accordingly, the right hood zipper slider 135 joins the right portions of the collar-side row of hood-connection zipper teeth 118 and the hood-side row of hood-connection zipper teeth 126, and the left hood zipper slider 133 joins the left portions of the collar-side row of hood-connection zipper teeth 118 and the hood-side row of hood-connection zipper teeth 126. For instance, the right zipper slider 135 is configured to selectively receive the right portion of zipper teeth, and the left zipper slider 133 is configured to selectively receive the left portion of zipper teeth.

For clarity, the top row of teeth 115 and the bottom row of teeth 117 of the collar zipper 114 along with the zipper sliders 120, 122 have been omitted from the depiction of the jacket 100 in FIG. 5. However, it should be appreciated that such components are still present on the jacket 100 when the hood 124 is attached to the collar 102 as shown in FIG. 5.

Figure 6:
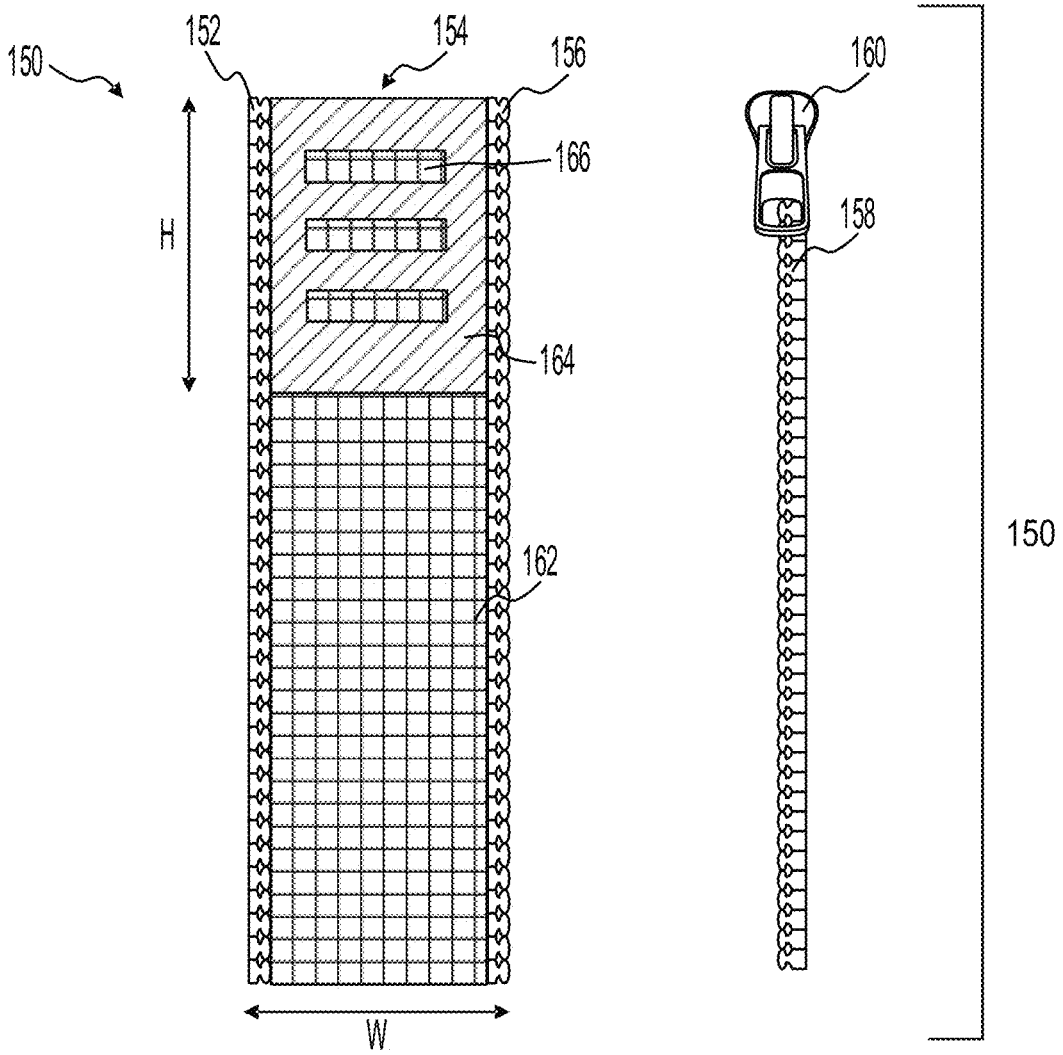
FIG. 6 depicts a central venting system.

FIG. 6 depicts a central venting system 150 for a jacket 100. The central venting system 150 may be incorporated into the central part of the jacket 100 to provide ventilation to a wearer, as discussed further below. The central venting system 150 includes an external row of vent zipper teeth 152, a vented flap 154, an internal row of vent zipper teeth 156, a primary row of zipper teeth 158, and a primary zipper slide 160 permanently attached to the primary row of zipper teeth 158. The width (W) of the vented flap 154 may be between about 4-10 cm.

The vented flap 154 includes multiple portions that provide different amounts of ventilation to the wearer. The top portion of the vented flap 154 is intended to be near the face and/or neck of a wearer, whereas the middle and bottom portions of the vented flap 154 are intended to be in front of the torso of the wearer. The middle and bottom portions of the vented flap 154 may include a vent material 162, such as mesh or other material that allows air to pass through the material. For instance, the vent material 162 allows for airflow to pass through the vented flap 154 to cool the torso of the wearer. The vent material 162 may extend to the bottom of the jacket 100 or within 10 cm of the bottom of the jacket 100.

The top portion of the vented flap 154 includes a non-vented material 164 with a plurality of face vents 166. The top portion of the vented flap 154 may correspond to the portion of the vented flap 154 that on the collar 102 of the jacket 100, and thus the top portion may also be referred to as a collar portion of the vented flap 154 or a collar portion of the central venting system 150. The height (H) of the collar portion may be between about 10-20 cm. The height (H) may be measured from the top of the vented flap 154, which may correspond to the top of the collar 102 of the jacket, to the bottom of the non-vented material 164. In some examples, the bottom of the non-vented material 164, or the start of the collar portion, is positioned at the neckline of the jacket 100 or within 3 cm of the neckline, such as 1-2 cm above the neckline.

The non-vented material 164 of the collar portion substantially prevents air from passing through the material. The face vents 166 may be made from vented material similar to the vent material 162. The face vents 166 allow for breath from the wearer to flow though the fabric and escape the jacket 100 through the face vents 166. The face vents 166 also allow for external air to flow though the fabric and reach the wearer's neck and/or face. Because the face of the wearer may be more sensitive to cold air, less ventilation may be desired near the face. As such, the face vents 166 that are incorporated into the non-vented material 164 are utilized near the face rather than an edge-to-edge portion of vent material 162 like what is incorporated into the torso portion of the vented flap 154. The number of face vents 166 incorporated may be based on the size of the face vents 166 and the size of each of the face vents 166 and the size of the collar portion of the vented flap 154. While the face vents 166 are depicted as rectangular, other shapes may also be used for the face vents 166. For example, arced shapes, circles, ovals, etc. may be used. In other examples, the face vents 166 may be shaped as letter blocks to indicate branding and/or a name of the jacket 100.

The central venting system 150 is configured to be selectively implemented by the wearer. For example, the wearer may choose to expose the vented flap 154, and thus provide ventilation, or to hide or confine the vented flap 154 to prevent ventilation through the vented flap 154. The selectivity is accomplished through the three rows of zipper teeth. For instance, to expose the vented flap 154, the wearer joins the internal row of vent zipper teeth 156 with the primary row of zipper teeth 158 by sliding the internal row of vent zipper teeth 156 through the throat of the primary zipper slider 160 and zipping the internal row of vent zipper teeth 156 and the primary row of zipper teeth 158 together. If the wearer prefers to hide the vented flap 154, the wearer joins the external row of vent zipper teeth 152 with the primary row of zipper teeth 158 by the sliding the external row of vent zipper teeth 152 through the throat of the primary zipper slider 160 and zipping the primary row of zipper teeth 158 and the external row of vent zipper teeth 152 together. When the external row of vent zipper teeth 152 and the primary row of zipper teeth 158 are joined together, the vented flap 154 is hidden or confined behind one of the chest panels 104, 106 and/or neck panels 108, 110 of the jacket 100. Thus, air external to the jacket 100 does not flow through the ventilated portions of the vented flap 154.

The central venting system 150 may include the external row of vent zipper teeth 152 that is attached to an outer or external edge of the vented flap 154. The external row of vent zipper teeth 152 faces the primary row of zipper teeth 158. The internal row of vent zipper teeth 156 is attached to an inner or internal edge of the vented flap 154. The internal row of vent zipper teeth 156 faces the primary row of zipper teeth 158. In other words, the teeth of the primary row of zipper teeth 158 face, or have an opposite orientation from, the teeth of the external row of vent zipper teeth 152 and the internal row of vent zipper teeth 156. Thus, the primary row of zipper teeth 158 may be selectively joined with either the external row of vent zipper teeth 152 or the internal row of vent zipper teeth 156.

Figure 7:
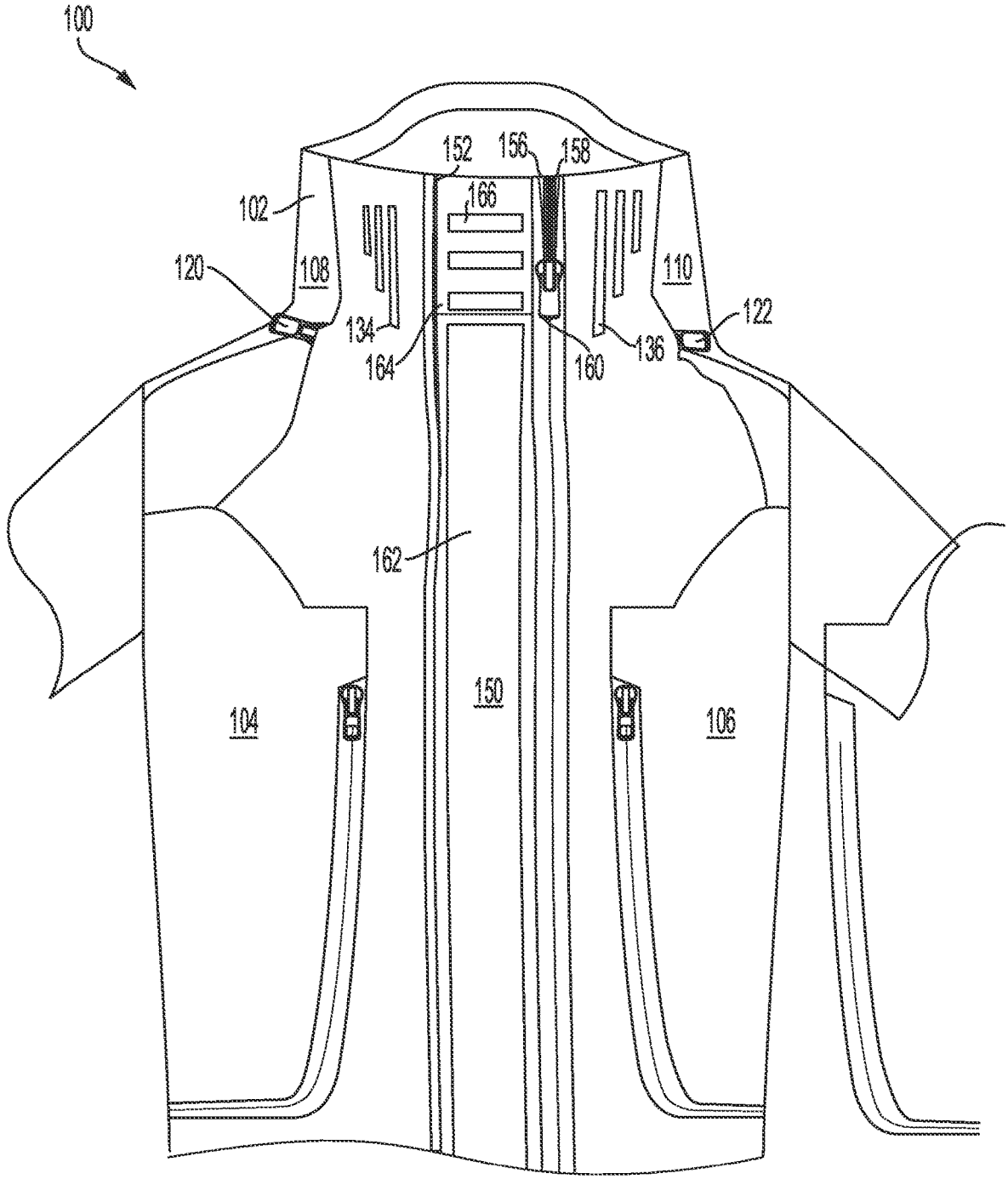
FIG. 7 depicts a front view a jacket having a central venting system.

FIG. 7 depicts a front view the jacket 100 having the central venting system 150. The central venting system 150 is in the vented state where the vented portions of the vented flap 154 are exposed. More specifically, in the vented state, the internal row of vent zipper teeth 156 of the vented flap 154 is joined with the primary row of zipper teeth 158. The external row of vent zipper teeth 152 thus remain unjoined to any other row of zipper teeth. If the wearer desired to change the central venting system 150 to an unvented state, the wearer could unzip the primary zipper slide 160, thus separating the internal row of vent zipper teeth 156 from the primary row of zipper teeth 158, and then zip the external row of vent zipper teeth 152 together with the primary row of zipper teeth 158. In the example depicted, if the external row of vent zipper teeth 152 were joined with the primary row of zipper teeth 158, the vented flap 154 would be hidden behind the left neck panel 110 and the left chest panel 106. In other examples, an additional row of teeth and zipper slider (not depicted) may be incorporated on the same side of the jacket 100 as the primary row of zipper teeth 158. In such examples, when the jacket is in the vented state, the wearer may change the jacket 100 to the unvented state by zipping the additional row of teeth together with the external row of vent zipper teeth 152. As should be appreciated the orientation of the central venting system 150 may be reversed such that in an unvented state, the vented flap 154 would be hidden behind the right chest panel 104 and the right neck panel 108.

To provide additional ventilation to the neck and face of the wearer, even when the central venting system 150 is in the unvented state, the collar 102 includes right side collar vents 134 and left side collar vents 136. The collar vents 134, 136 may have similar construction, and may be made from the same or similar vented material, as the face vents 166. The collar vents 134, 136 provide ventilation that can help breath from the wearer escape through the jacket 100, which can help prevent fogging of eyewear, such as ski goggles. The collar vents 134, 136 may each extend in a top-to-bottom direction of the jacket 100. For instance, the top-to-bottom dimension (e.g., height) of the collar vents 134, 136 may be greater than a left-to-right dimension (e.g., width) of the collar vents 134, 136. The heights of the collar vents 134, 136 may also change as their position changes around the collar 102. For instance, the collar vents 134, 136 near the center of the jacket 100 may have a larger height than the collar vents 134, 136 located further away from the center of the jacket 100.

Figure 8:
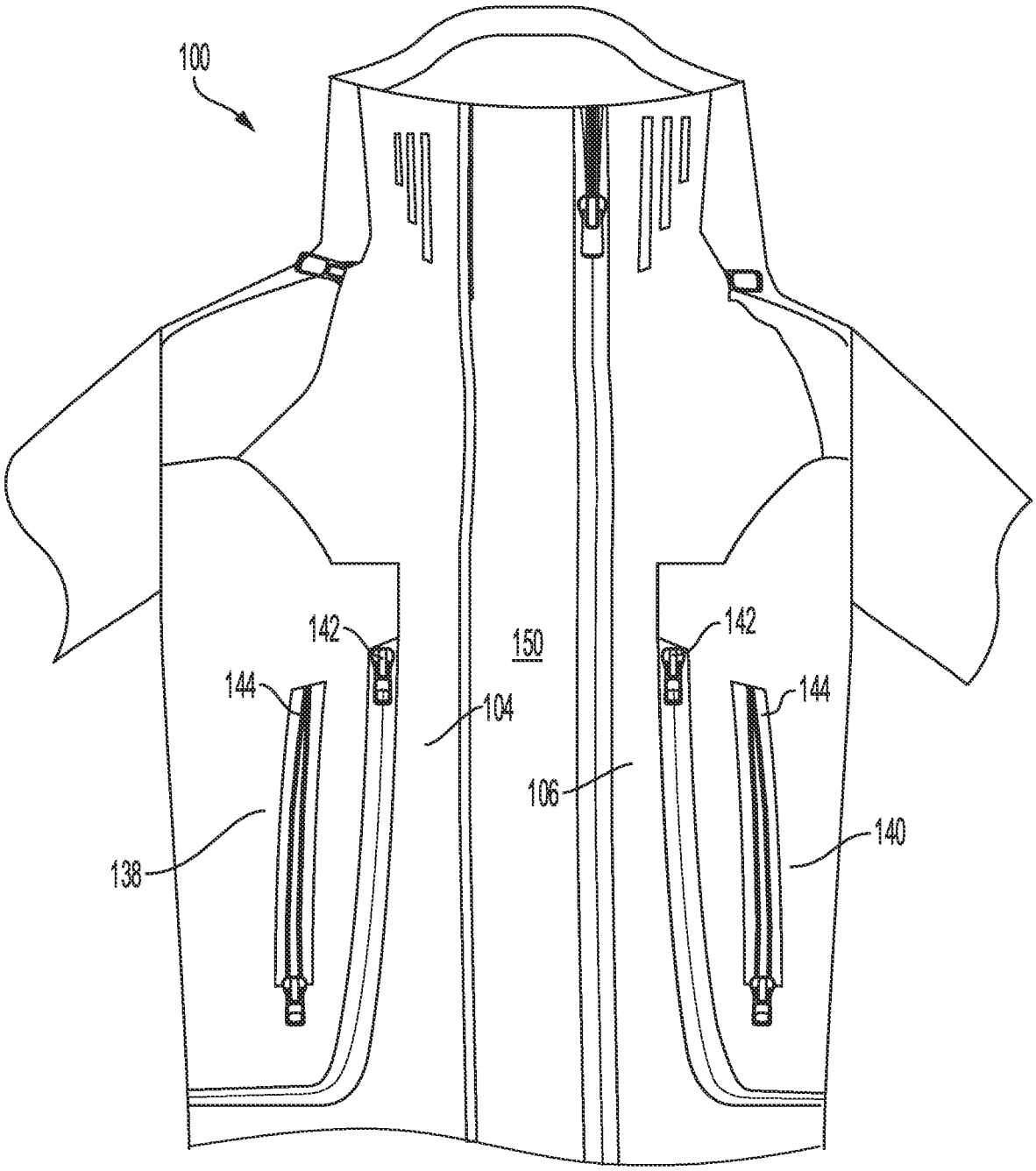
FIG. 8 depicts a jacket having expandable pockets.

FIG. 8 depicts a jacket 100 having expandable pockets 138, 140. More specifically, the jacket 100 includes a right-side pocket assembly 138 and a left-side pocket assembly 140. The right-side pocket assembly 138 is located on the right chest panel 104, and the left-side pocket assembly 140 is located on the left chest panel 106. The right-side pocket assembly 138 includes an expansion zipper 142 and an exterior pocket zipper 144. The left-side pocket assembly 140 also includes an expansion zipper 142 and an exterior pocket zipper 144.

The exterior pocket zipper 144 controls access to an exterior pocket that may be used for storage. The expansion zipper 142 may be unzipped to allow for expansion of the exterior pocket. For instance, gusseted material may be included in the interior fabric of the exterior pocket that allows the exterior pocket to expand when the expansion zipper 142 is unzipped. When the expansion zipper 142 is zipped, the exterior pocket is contracted tighter towards the respective chest panel 104, 106. This selective expansion of the exterior pocket provided by the expansion zipper 142 and the gusseted material provides additional functionality of the jacket 100. For example, when a wearer needs more storage, the wearer is able to selectively expand one or both of the right-side pocket assembly 138 and the left-side pocket assembly 140. If the additional storage is not desired or required, the wearer may contract the right-side pocket assembly 138 and/or the left-side pocket assembly 140 to pull the material of the assemblies 138, 140 closer to the chest panels 104, 106. Contraction of the material prevents of the material from flapping in the wind as the wearer skis, which also improves the aerodynamics of the jacket 100.

Figure 9:
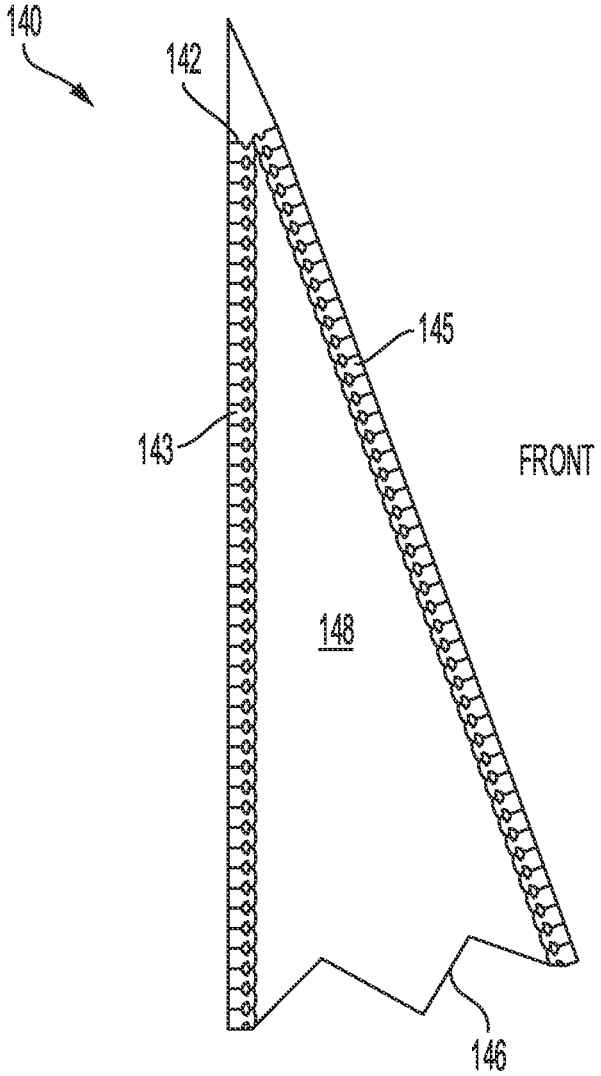
FIG. 9 depicts a side view of an expandable pocket.
Figure 11:
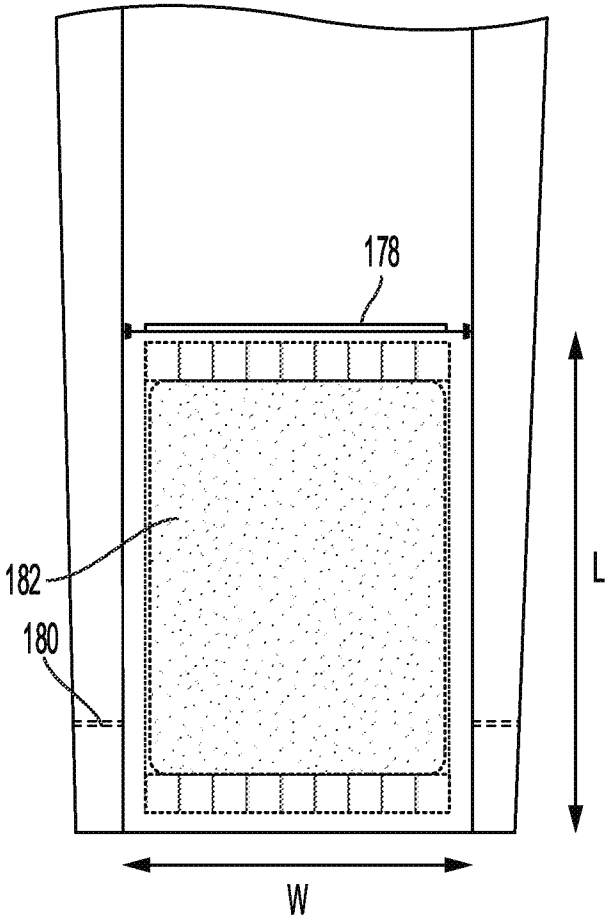
FIG. 11 depicts a schematic palm-side view of the sleeve with the hand-warmer pocket.
Figure 10:
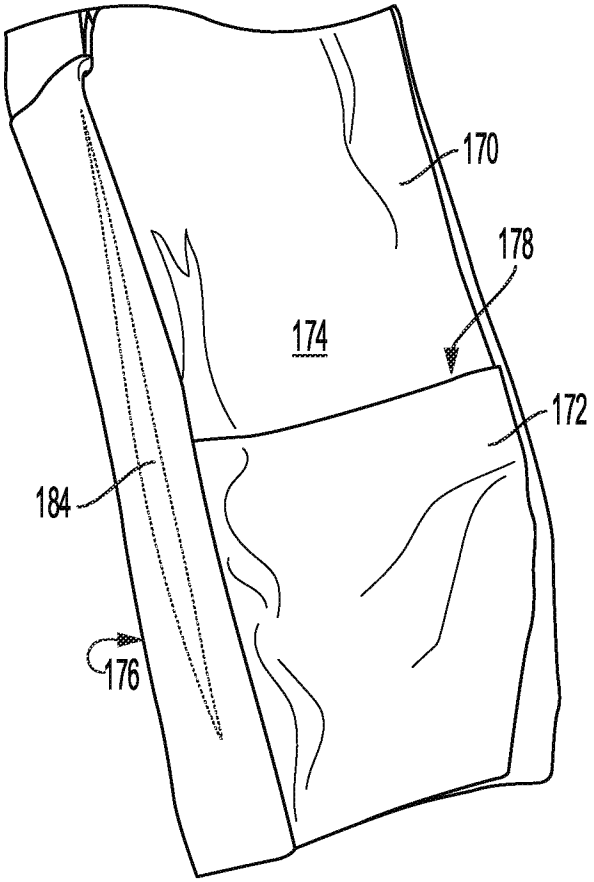
FIG. 10 depicts a palm-side view of a sleeve with a hand-warmer pocket.

FIG. 9 depicts a side view of the left-side pocket assembly 140 as viewed from the right side of the jacket 100. The left-side pocket assembly 140 is shown in the unzipped or expanded state. When the expansion zipper 142 is unzipped, an interior row of pocket zipper teeth 143 is at least partially separated from an exterior row of pocket zipper teeth 145. Separation of the rows of zipper teeth 143, 145 allows for a gusset 146 of the left-side pocket assembly 140 to expand. Thus, additional storage space 148 is provided in the left-side pocket assembly 140. The storage space may be accessed by unzipping the exterior pocket zipper 144. In some examples, unzipping the expansion zipper 142 may expose another zipper (not depicted) that also or alternatively controls access to storage space of the left-side pocket assembly 140. While the left-side pocket assembly 140 is depicted in FIG. 9, it should be appreciated that the right-side pocket assembly 138 may have a similar, but mirrored, construction or configuration FIG. 10 depicts a palm-side view of a sleeve 170 with a hand-warmer pocket 172. FIG. 11 depicts a schematic palm-side view of the sleeve 170 with the hand-warmer pocket 172. The sleeve 170 includes an inner wrist side 174 and an outer wrist side 176. The inner wrist side 174 of the sleeve 170 is the side of the sleeve that is generally on the same side of the palm of a wearer (e.g., the palm-side). The outer wrist side 176 is the side of the sleeve 170 that is opposite the inner wrist side 174. In the example depicted, the hand-warmer pocket 172 is incorporated on the inner wrist side 174, but in other examples, the hand-warmer pocket 172 may be incorporated on the outer wrist side 176.

The hand-warmer pocket 172 may be formed as an additional panel of material that is external the to the inner wrist side 174 of the sleeve 170, which thus forms a cavity or pocket between the external panel of material and the portion of the sleeve 170 located underneath the external panel. The length (L) of the hand-warmer pocket 172 may be between about 7-15 cm or about 9-11 cm. The width (W) of the hand-warmer pocket 172 may be between about 5-10 cm. A hem stich 180 may be provided underneath the external panel of fabric. For instance, the hem stitch 180 may be formed on the interior sleeve 170 material but not the external panel.

The hand-warmer pocket 172 includes a pocket entry 178 to insert and remove a hand warmer 182. The pocket entry 178 may be reinforced through the use of added fabric or tape, such as elastic seam tape. The pocket entry 178 may also include a double layer of the external material. For example, the external material forming the outer panel of the hand-warmer pocket 172 may be folded over at the pocket entry 178 to form a double layer. The material may also be folded inward to provide a hooked portion of the material to help retain the hand warmer 182.

In some examples, the sleeve 170 may also include a sleeve vent 184. The sleeve vent 184 may be incorporated on radius wrist side of the sleeve 170 and/or the ulna wrist side of the sleeve 170. The sleeve vent 184 may be zippered such that the wearer may selectively open or close the sleeve vent 184.

Although specific devices have been recited throughout the disclosure as performing specific functions, one of skill in the art will appreciate that these devices are provided for illustrative purposes, and other devices may be employed to perform the functionality disclosed herein without departing from the scope of the disclosure. This disclosure describes some embodiments of the present technology with reference to the accompanying drawings, in which only some of the possible embodiments were shown. Other aspects may, however, be embodied in many different forms and should not be construed as limited to the embodiments set forth herein. Rather, these embodiments were provided so that this disclosure was thorough and complete and fully conveyed the scope of the possible embodiments to those skilled in the art. Further, as used herein and in the claims, the phrase "at least one of element A, element B, or element C" is intended to convey any of: element A, element B, element C, elements A and B, elements A and C, elements B and C, and elements A, B, and C. Further, one having skill in the art will understand the degree to which terms such as "about" or "substantially" convey in light of the measurement techniques utilized herein. To the extent such terms may not be clearly defined or understood by one having skill in the art, the term "about" shall mean plus or minus ten percent.

Although specific embodiments are described herein, the scope of the technology is not limited to those specific embodiments. Moreover, while different examples and embodiments may be described separately, such embodiments and examples may be combined with one another in implementing the technology described herein. One skilled in the art will recognize other embodiments or improvements that are within the scope and spirit of the present technology. Therefore, the specific structure, acts, or components are disclosed only as illustrative embodiments. The scope of the technology is defined by the following claims and any equivalents therein.

What is claimed is:

1. A garment comprising:
a right chest panel;
a left chest panel;
a back panel; and
a collar coupled to the right chest panel, the left chest panel, and the back panel, the collar comprising:
a collar zipper and a collar pocket, the collar zipper configured to control access to the collar pocket, the collar zipper extending around at least 80% of an outer circumference of the collar; and
a collar-side row of hood-connection zipper teeth positioned in the collar pocket, the collar-side row of hood-connection zipper teeth having a length that is at least 80% of a length of the collar zipper; and
a removable hood comprising:
a hood-side row of hood-connection zipper teeth, the hood-side row of hood-connection zipper teeth having a length that is substantially equal to the length of the collar-side row of hood-connection zipper teeth, and
wherein the collar pocket, when completely vacant, does not include enough storage space to store the removable hood.

2. The garment of claim 1, wherein the removable hood further comprises at least one zipper slider permanently attached to the hood-side row of hood-connection zipper teeth and configured to selectively receive the collar-side row of hood-connection zipper teeth.

3. The garment of claim 1, wherein the collar-side row of hood-connection zipper teeth is split into a left portion of zipper teeth and a right portion of zipper teeth.

4. The garment of claim 3, further comprising:
a left zipper slider permanently attached to the hood-side row of hood-connection zipper teeth, the left zipper slider configured to selectively receive the left portion of zipper teeth; and
a right zipper slider permanently attached to the hood-side row of hood-connection zipper teeth, the right zipper slider configured to selectively receive the right portion of zipper teeth.

5. The garment of claim 1, wherein the collar zipper includes a left zipper slider and a right zipper slider, wherein the collar zipper is configured to be opened when the left zipper slider and the right zipper slider are pulled apart from one another.

6. The garment of claim 1, wherein the collar-side row of hood-connection zipper teeth extends around at least 80% of the outer circumference of the collar.

7. The garment of claim 1, wherein the hood-side row of hood-connection zipper teeth extends from a left hood-opening edge to a right hood-opening edge.

8. The garment of claim 1, wherein the collar zipper has the length greater than the length of the collar-side row of hood-connection zipper teeth.

9. The garment of claim 1, further comprising:
a right neck panel; and
a left neck panel,
wherein the collar zipper extends from a right edge of the right neck panel to a left edge of the left neck panel.

10. The garment of claim 1, wherein the garment is a ski jacket.

11. A garment comprising:
a right chest panel;
a left chest panel;
a back panel;
a right neck panel;
a left neck panel;
a collar coupled to the right chest panel, the left chest panel, the right neck panel, the left neck panel, and the back panel, the collar comprising:
a collar zipper and a collar pocket, the collar zipper configured to control access to the collar pocket, the collar zipper extending from a right edge of the right neck panel to a left edge of the left neck panel; and
a collar-side row of hood-connection zipper teeth positioned in the collar pocket; and
a removable hood comprising:
a hood-side row of hood-connection zipper teeth, wherein the hood-side row of hood-connection zipper teeth has a length that is substantially equal to a length of the collar-side row of hood-connection zipper teeth, and
wherein the collar pocket, when completely vacant, does not include enough storage space to store the removable hood.

12. The garment of claim 11, wherein the removable hood further comprises at least one zipper slider permanently attached to the hood-side row of hood-connection zipper teeth and configured to selectively receive the collar-side row of hood-connection zipper teeth.

13. The garment of claim 11, wherein the collar further comprises at least one zipper slider permanently attached to the collar-side row of hood-connection zipper teeth and configured to receive the hood-side row of hood-connection zipper teeth.

14. The garment of claim 11, wherein the collar zipper extends around at least 80% of an outer circumference of the collar.

15. The garment of claim 11, wherein the hood-side row of hood-connection zipper teeth extends from a left hood-opening edge to a right hood-opening edge.

16. The garment of claim 11, further comprising a primary zipper positioned between the right chest panel and the left chest panel and between the right neck panel and the left neck panel.

17. A garment comprising:

a collar comprising:

a collar pocket;

a collar zipper configured to control access to the collar pocket; and a collar-side row of hood-connection zipper teeth positioned in the collar pocket, wherein the collar-side row of hood-connection zipper teeth extends around at least 80% of an outer circumference of the collar;

a removable hood comprising:

a hood-side row of hood-connection zipper teeth, wherein the hood-side row of hood-connection zipper teeth extends around at least 80% of a circumference of a bottom edge of the removable hood; and at least one zipper slider permanently attached to one of the collar-side row of hood-connection zipper teeth or the hood-side row of hood-connection zipper teeth and configured to selectively receive the other one of the collar-side row of hood-connection zipper teeth or the hood-side row of hood-connection zipper teeth, and wherein the collar pocket, when completely vacant, does not include enough storage space to store the removable hood.

18. The garment of claim 17, wherein the collar zipper has a length greater than a length of the collar-side row of hood-connection zipper teeth.

19. The garment of claim 17, wherein the removable hood includes a right hood-opening edge and a left hood-opening edge, and the removable hood does not include attachment mechanisms for attaching the right hood-opening edge to the left hood-opening edge.

* * * * *